United States Patent [19]

Ross

[11] Patent Number: 4,598,907

[45] Date of Patent: Jul. 8, 1986

[54] WEIGHT LIFTING TYPE EXERCISE MACHINE

[75] Inventor: Arden I. Ross, 6820 Espanita St., Long Beach, Calif. 90815

[73] Assignees: Arden I. Ross; Wallace L. Ross, both of Long Beach, Calif. ; a part interest

[21] Appl. No.: 404,329

[22] Filed: Aug. 2, 1982

[51] Int. Cl.[4] ..... A63B 21/06

[52] U.S. Cl. ..... 272/117; 272/134

[58] Field of Search ..... 272/117, 118, 134, 143, 272/144, 116, 123, 122, 142

[56] References Cited

U.S. PATENT DOCUMENTS

| | | | |
|---|---|---|---|
| 3,708,167 | 1/1973 | Potbieter | 272/117 |
| 3,858,873 | 1/1975 | Jones | 272/117 |
| 4,226,414 | 10/1980 | Coffaro et al. | 272/117 |
| 4,372,553 | 2/1983 | Hatfield | 272/142 X |

FOREIGN PATENT DOCUMENTS

| | | | |
|---|---|---|---|
| 2303970 | 2/1974 | Fed. Rep. of Germany | 272/134 |

*Primary Examiner*—Richard J. Apley
*Assistant Examiner*—William R. Browne
*Attorney, Agent, or Firm*—Fulwider, Patton, Rieber, Lee & Utecht

[57] ABSTRACT

A selectively configurable exercise machine includes a vertical frame in an inverted V-shape which is coupled to a horizontal weight platform. The weight platform includes a free-swinging end for carrying the weights and an opposite end which forms a double pivotal connection with the vertical frame. The double pivotal connection is formed by a pair of rocker arms pivotally connected on one end to the weight platform and pivotally connected on the opposite end of the rocker arm to the vertical frame. The weight platform is suspended by multiple pulleys threaded with a single flexible line which may be held by the user for performing a variety of one and two-handed exercises.

9 Claims, 5 Drawing Figures

FIG. 3
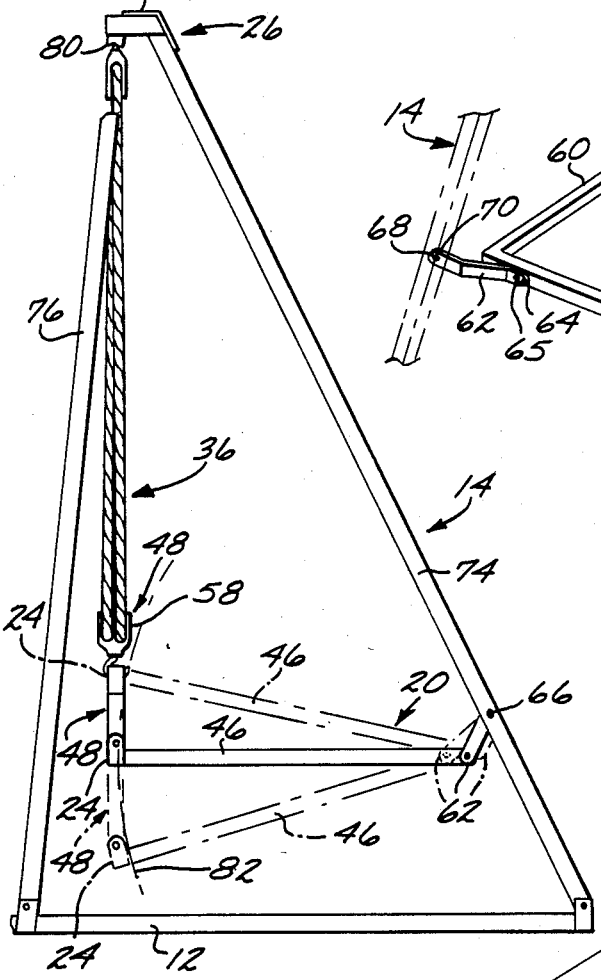
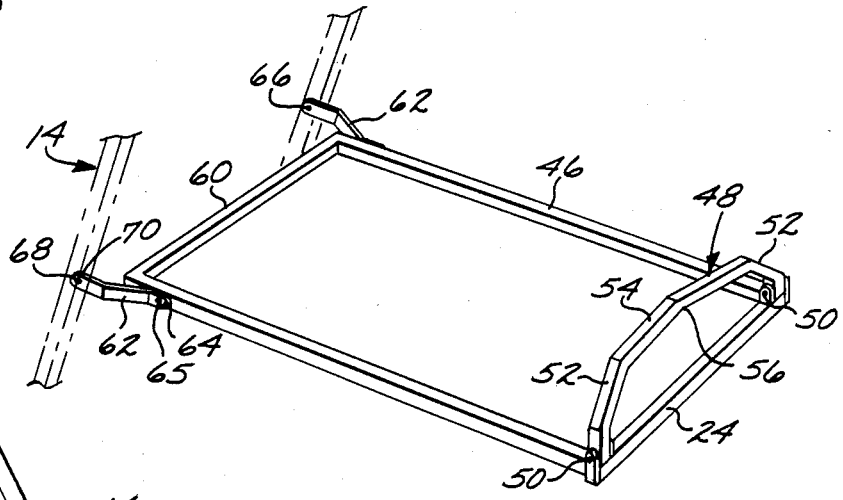
FIG. 4
FIG. 5
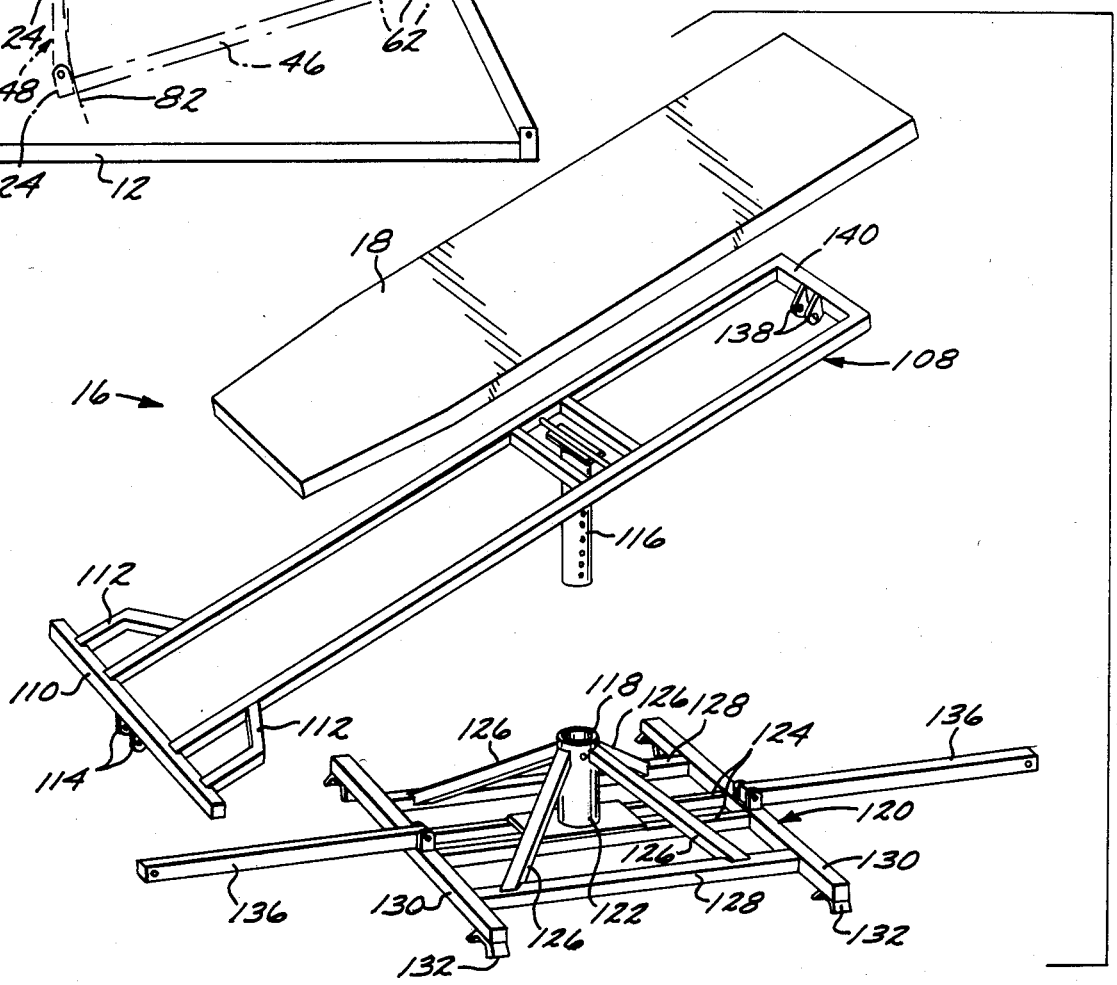

WEIGHT LIFTING TYPE EXERCISE MACHINE

BACKGROUND OF THE INVENTION

1. Field of the Invention

The present invention relates to the field of exercise apparatus and more particularly relates to apparatus using a combination of pulleys, rope pulls and weights.

2. Description of the Prior Art

Combinations of rope pulls and pulleys and weights have long been used in exercise apparatus in which the user would pull on a bar or rope end against the resistive force exerted through the pulley system by the action of the weight. See for example J. E. Dowd, "Exercising Machine," U.S. Pat. No. 426,249.

More recently, exercising apparatus have included weight and pulley systems combined to provide a resistive force in a specified line of direction all with respect to a defined axis of rotation or pull in order to provide the resistive force in a machine specialized for the performance of a specific exercise. See for example Proctor, "Weight Resistant Chest Exercising Device," U.S. Pat. No. 3,640,527; McArthur, "Limb Exercising Apparatus," U.S. Pat. No. 4,125,258; Lambert, Jr., "Leg Extension, Leg Curl, Hip, Thigh, Back and Buttocks Machine," U.S. Pat. No. 4,200,279.

The prior art has also devised a number of exercising machines utilizing weight and pulley systems adaptable to a larger variety of exercises, such as shown by Reach, "Exercising Apparatus," U.S. Pat. No. 1,052,962; Thayer, "Exercising Machine," U.S. Pat. No. 448,305; Morris, "Exercising Device," U.S. Pat. No. 2,977,120 and Sullivan, et al, "Portable Home Gymnasium," U.S. Pat. No. 4,257,590. However, each of these prior art exercising machines included a limitation that the weight which provided the resistive force was either totally unrestrained thereby presiding not only hazard but a loose feel, as in Sullivan; or that the weight was restrained by guides, rails or clasps, such as in Morris, Thayer and Reach, in such a manner that the fluidity of the resistive force was substantially lost or such that frequent and heavy lubrication of the sliding parts which restrained the hanging weight, was required in order to ensure trouble free operation.

Therefore, what is needed is an exercise machine which is selectively alterable to allow the performance of a large number of types of exercise and yet still provides a smooth and free-flowing resistive force without the disadvantage or hazard of a swinging, unrestrained weight.

BRIEF SUMMARY OF THE INVENTION

The present invention is an exercise apparatus which includes a vertical A-frame in the shape of an inverted "V" which has upper and lower portions particularly characterized by a front pair of legs and a rear pair of legs. A weight platform, having one free-swinging end which is arranged and configured for carrying weights, has an end opposing the free-swinging end, which is rotatably coupled to the lower portion of the frame and in particular to the lower portion of the rear pair of legs. A pulley system is included and coupled to the upper portion of the frame, near the top of the inverted "V" shaped apex, and includes a lift pulley coupled to the platform by a flexible line interconnecting the pulleys at the top of the A-frame with the left pulley so that a rotary force can be imparted through the ends of the line to the platform. Finally, a weight is coupled to the platform to appropriately load the platform. By this combination of elements, a user may exert force on the pulley system, thereby causing the platform to rotate and the weights to be lifted and lowered with respect to the frame, with a minimal amount of frictional drag and binding, and yet with a maximum amount of smooth working action. The arrangement of the pulleys in the upper and lower portion of the frame can be varied to change the angle of the line from the A-frame to the user to provide an extremely large number of options to accomodate a corresponding large number of types of exercises.

The invention further includes a particular rotatable coupling between the weight loaded platform and the vertical A-frame. A double linkage is rotatably coupled to the lower portion of the rear pair of legs of the frame at one end, and is similarly rotatably coupled to the platform at the other end of the linkage. The links of the platform and doubly rotatable linkage form, in combination, a joint lever arm, which allows the weight loaded platform to swing to and fro by the extent of the length of the double linkage so that the lift pulley connected to the platform always swings directly underneath the supporting pulley connected to the top of the A-frame. Thus, as the platform rotates with respect to the A-frame, the weights attached to the platform always rise and fall on a direct vertical line, thereby further facilitating the secure and smooth working action of the exercise apparatus.

These and other embodiments of the present invention are best understood when viewing the following Figures in light of the Detailed Description of the Preferred Embodiments.

BRIEF DESCRIPTION OF THE DRAWINGS

FIG. 3 is a fragmentary side elevational view of the weight bearing portion of the exercising apparatus illustrated in the action of the floating platform.

FIG. 4 is a perspective view in enlarged scale of the platform and rotatable arms as seen in isolation from the remaining portions of the exercising apparatus.

FIG. 5 is an exploded, perspective view of the adjustable bench included as part of the exercising apparatus.

DETAILED DESCRIPTION OF THE PREFERRED EMBODIMENTS

Figures 1, 2:
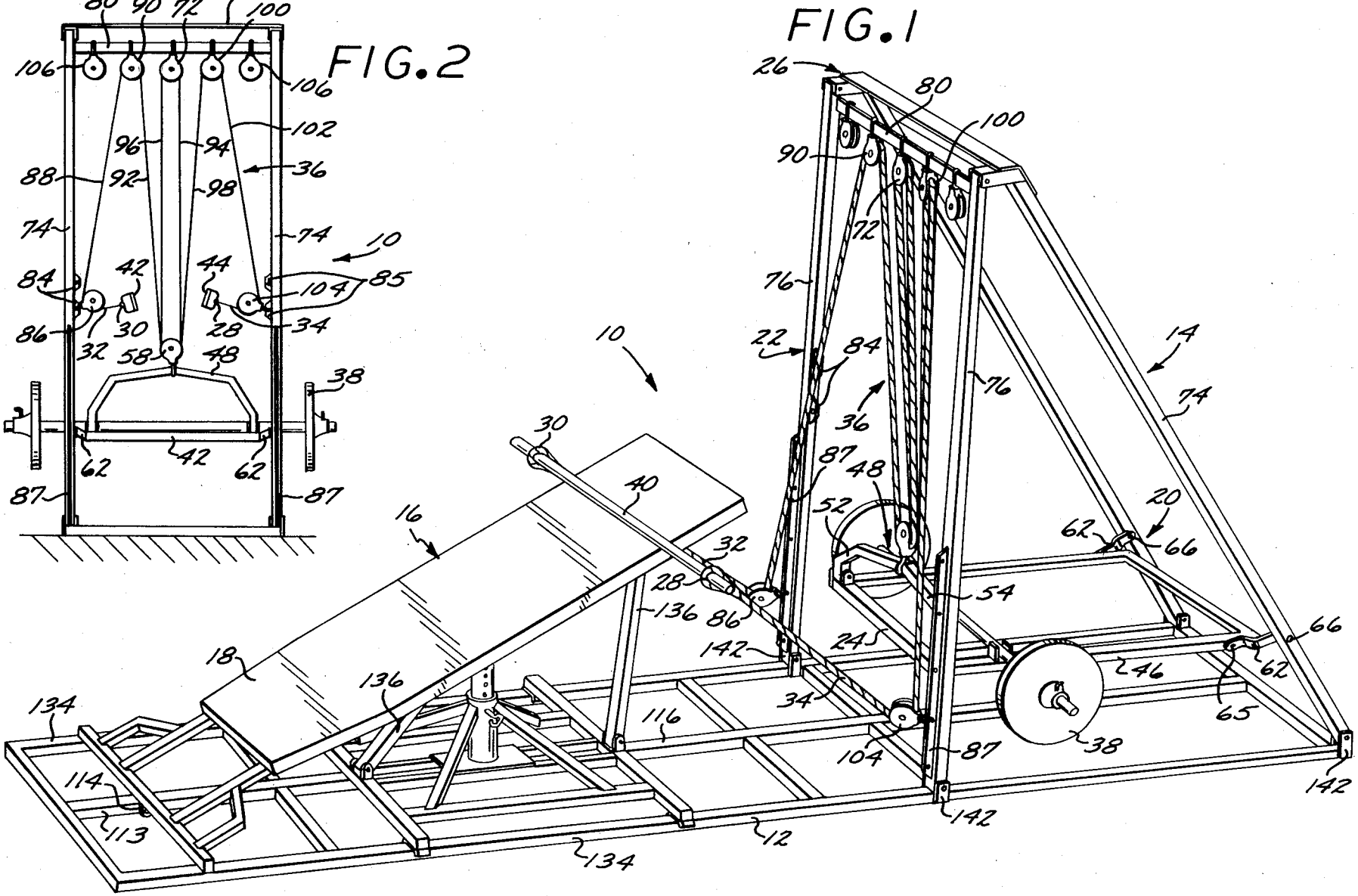
FIG. 1 is a perspective view of the exercising apparatus of the present invention.
FIG. 2 is a front elevational view taken through lines 2—2 of FIG. 1 wherein the bar of FIG. 1 has been replaced by hand grips and the position of the lower pulleys with respect to the frame changed.

The present invention is an exercising machine using a combination of pulleys and weights which incorporates a free-floating platform which provides the smooth, free feel of a hanging weight and yet the rigidity, safety and uniform operation of a restrained weight. Thus for any given exercise, the exercising machine provides the smooth, sure feel of prior art machines having hydraulic resistive elements which are designed to provide the resistive force through a mechanism designed for a single type of exercise. However, the present invention provides adaptability and flexibility of a rope pull exercise machine and thus can be used for an arbitrarily large number of different types of exercises.

Refer now to FIG. 1 wherein a perspective view of the exercise machine of the present invention is illustrated. Exercise machine, generally denoted by reference numeral 10, includes a base 12, an A-frame portion, generally denoted by reference numeral 14, and an adjustable bench, generally denoted by reference numeral 16. A-frame 14, which has the shape of an inverted "V", is coupled to base 12 at one end of the base while the remaining portion of base 12 serves as a track upon which bench 16 may slide. Bench 16 can not only be moved toward or away from A-frame 14 but includes a support board 18 whose angular orientation with respect to the horizontal can be arbitrarily adjusted. A weight platform, generally denoted by reference numeral 20, is rotatably coupled to A-frame 14 at one end of the platform and suspended at the other end of the platform by means of a pulley system, generally denoted by reference numeral 22. Pulley system 22 couples the free-swinging end 24 of platform 20 by means of a flexible line and a plurality of pulleys to the upper portion 26 of A-frame 14. Thus, as will be described in greater detail below, the user lies on adjustable bench 16 at an orientation and position selected according to the exercise to be performed and clasps directly or indirectly, ends 28 and 30 of lengths 32 and 34 of the line of pulley system 22, the line being generally denoted by reference numeral 36. Extension or retraction of ends 28 and 30 of line 36 are resisted by the force exerted on line 36 by weighted platform 20, which may include a conventional pair of bar bells 38 attached near or at free-swinging end 24 of platform 20. The position of bar bells 38 on platform 20 within A-frame 14 is maintained within a range of positions by means of the coupling of platform 20 to A-frame 14 as described below. As a result of this coupling, as platform 20 is raised and lowered, or as line 36 is run through the plurality of pulleys of pulley system 22, the movement and feel of the weight is secure, smooth and steady. The action and resistive force imparted by bar bells 38 upon line 36 and ultimately on the user's body through ends 28 and 30 is nearly as natural as if there were no interacting apparatus between the user and bar bells 38.

Ends 28 and 30 may be moved in unison by appropriate coupling with a bar 40 such as shown in FIG. 1 or may be coupled to individual hand or foot stirrups 42 and 44 as illustrated in FIG. 2. The variety of exercises which may be performed by exercise machine 10 is virtually unlimited. However, with each exercise, the resistive force provided by exercise machine 10 is smooth, reliable and secure just as if the user were working against a conventional hydraulically actuated exercise machine, or directly against the bar bells themselves.

Referring again to FIG. 1 the details of the present invention and the manner by which the objects and advantages are achieved can now be better understood. Platform 20 includes a generally rectangular or square-shaped frame having sides 46 and ends 24 and 60 illustrated in enlarged scale in FIG. 4. Platform 20 is rotatably coupled to a lifting harness 48 at free-swinging end 24 by means of conventional pivot pins 50 provided between each end of harness 48 and end 24. Harness 48 is generally C-shaped, having inclined portions 52 coupled at one end by pivots 50 to frame 46 and leading at the other end to integral horizontal portion 54. Horizontal portion 54 may include a lifting stirrup 56 into which a pulley hook is inserted and centered or may include a bend or fitting for a pulley attachment. It is also entirely within the scope of the present invention that horizontal portion 54 may include no special shape or fitting for pulley attachment which will simply be made by means of a strap or hook engaging portion 54 of lifting harness 48. In addition, lifting harness 48 may be fixed or secured at or near free-swinging end 24 by welding, bolting or other conventional means. In such a case, the flexibility between the pulley and lifting harness 48 will then be provided by the pulley to lifting harness attachment or simply in the inherent flexibility of line 36 wooven through lifting pulley 58.

The opposing end 60 of platform 20 is coupled to A-frame 14 by means of rocker arms 62 connected at or near end 60. In the preferred embodiment rocker arms 62 are bent arms having one end 64 rotatably attached to sides 46 by a pivot pin 65 and the opposing end rotatably coupled to A-frame 14 through a pivot 66. Pivot 66 may simply be a bushing and bolt disposed through a corresponding hole 68 in end 70 of rocker arm 62 and A-frame 14 or, in the case where rocker arm 62 is angled rod, may include an integral extension of rocker arm 62 disposed through a corresponding hole in frame 14. Ends 64 are similarly rotatably coupled to sides 46 and thus provide a desirable free floating action to platform 20 wherein platform 20 centers itself beneath center pulley 72 coupled to upper portion 26 of Frame 14 at all angular orientations of platform 20 within the operating range.

FIG. 3 diagramatically illustrates in fragmentary view of machine 10 the doublely pivoted, free floating of action of platform 20 within A-frame 14. Platform 20 is shown in solid outline in a substantially horizontal position and in dotted outlines at an upper and lower inclined position. FIGS. 1 and 3 also show A-frame 14 in side view as including a rear leg 74 and front leg 76, each coupled at one end to base 12 and coupled at their opposing ends to a top plate 78 forming part of upper portion 26 of A-frame 14. Upper pulley 72 is coupled to a downwardly directed flange 80 formed as part of top plate 78 with lines 36 roven through pulleys 58 and 72 in a manner described in greater detail in connection with FIG. 2 below.

When in the horizontal position shown in solid outline, arm 62 of platform 20 assumes a first position which allows free-swinging end 24 of platform 20 to be positioned directly beneath upper pulley 72. If the length between free-swinging end 24 and pivot 66 were constant, free-swinging end 24 would trace the path of arc 82 shown in dotted outline. However, according to the present invention, when platform 20 assumes an upper or lower inclined position as shown in dotted outline in FIG. 3, arms 62 assume a second extended position which allows free-swinging end 24 of platform 20 to be displaced to the left of arc 82 in FIG. 3 and thus remain directly beneath upper pulley 72. Bar bells 38 are then raised and lowered in a vertical line. The restoring force of gravity will always tend to urge bar bells 38 directly beneath a fixed point on top plate 78. The length of doubly pivoted arm 62 will provide the necessary extension to allow bar bell 38 to deviate from arc 82 to achieve this purpose. The vertical alignment of bar bells 38 on a predetermined vertical line is achieved during all inclinations of platform 20 with respect to A-frame 14 in an operable range of approximately 5° to 125° degrees. It is possible that platform 20 could assume an extreme angle as described below as a result of the application of an impulsive force. However, the length of arms 62 is empiracally chosen to provide the necessary extension as taught herein for the usual range of angular orientations assumed by platform 20 during normal use.

It is possible during particularly strenuous exercise, such as when a strong impulsive force is imparted to lines 36 and little weight placed upon bar bells 38, that bar bells 38 will be urged to rotate about pivot point 66 out of the normal operating ranges. However, because of doubly pivoted arms 62, bar bells 38 are not thrown out of A-frame 14 but are securely maintained therein. For example, as bar bells 38 are thrown upward, platform 20 reaches an inclination wherein arm 62 simply folds and rotates in a complete circle about pivot point 66. Lines 36 depart from their normal vertical alignment and swing to the right as illustrated in FIG. 3. In a particularly violent swing, it can be imagined that platform 20 and arm 62 might be aligned for a moment as bar bells 38 swing toward back legs 74. However, as soon as arm 62 is aligned with the plane of platform 20 the forward rotation of arm 62 and platform 20 together with any downward force whatsoever in the direction of the plane of platform 20, causes arm 62 to buckle outwards and complete a 360° rotation around pivot 66. When this occurs, the combined length of platform 20 and arm 62 suddenly decreases allowing bar bell 38 to fall and absorb some of the energy imparted to bar bell 38 by the impulsive force. Arm 62 continues to rotate completely about pivot point 66 until it returns to the initial position assumed before the application of the impulsive force to bar bell 38. The sudden collapse of arm 68 caused by its buckling outward and its rotation about pivot point 66 help to safely and securely retain bar bells 38 within A-frame 14. However, after the combined lever arm of platform 20 and arm 62 buckles, arm 62 returns to its initial position so that platform 20 is automatically reset for normal use.

Referring now to FIG. 2 the coupling between ends 28 and 30 of line 36 can be better understood as the exercise apparatus is viewed through lines 2—2 of FIG. 1 as seen from the end of base 12 closest to rear leg 74. Beginning at hand grip 42 and end 30, line 36 is roven through pulley 84 which is coupled to a hole provided in a flange 86 and formed as part of front leg 76, better illustrated in FIG. 1. FIG. 1 illustrates that pulley 86 is coupled to flange 87 at a hole defined in its lower portion while pulley 86 is coupled to upper flange 84 in FIG. 2. Pulley 86 is a conventional snatch block well known in marine applications and is easily removeable and attachable to any of the holes in flange 84 or 87. Line 36 runs from pulley 86 along run 88 to an upper, side pulley 90 best illustrated in FIG. 2. Pulley 90 is coupled to downwardly extending flange 80 of top plate 78 and may also be a conventionally designed snatch block. Line 36 then proceeds from pulley 90 downward along run 92 to lift pulley 58, a conventional double sheaved pulley. Line 36 is roven through one sheave of lift pulley 58 upwardly on run 94 to upper center pulley 72. Line 36 is then rove through upper pulley 72 back down toward lift pulley 58 along run 96 through a second sheave in lift pulley 58. After being twice roven through lift pulley 58, line 36 runs upwardly on run 98 to upper, side pulley 100. Again, side pulley 100 is a single sheaved, conventional snatch block used for a change in direction of line 36. Line 36 is roven through side pulley 100 and runs downwardly along run 102 to lower pulley 104. Pulley 104 is also a conventional snatch block similar to pulley 86 and is selectively coupled to an opposing flange 85 on opposing front leg 76 of A-frame 14.

Additional pulleys 106, also conventional snatch blocks, may also be provided and attached to flange 80 of top plate 78 to increase the flexibility and the number of ways in which line 36 may be configured to best adapt to a particular exercise. For example, pulleys 106 may be used when it is desired to have the direction of pull from above.

The flexibility by which line 36 may be configured is one of the particular advantages of the present invention. The direction of pull may be selectively chosen in such a manner that the position and direction of the resistive force can be precisely controlled to effect a specified result. For example, by selectively choosing different points on flange 87 to which pulleys 86 and 104 are coupled, the upper or lower portions of the biceps of a user seated upon bench 16 can be particularly exercised. In addition, although the embodiments in FIGS. 1 and 2 have each shown line 36 roven through lower blocks 86 and 104, in some exercises it is necessary to have the resistive force directed towards upper side blocks 90 and 100. In that case, pulleys 84 and 104 are unused and line 86 led directly from the upper pulleys, or line 36 may be roven through pulleys 84 and 104 up through pulleys 106.

The operation of platform 20 may now be understood in connection with the particular pulley system 22 illustrated in FIG. 2. If hand grip 42 is drawn toward the user away from A-frame 14, line 36 runs through pulley 86 to lengthen run 32. If at the same time, the opposite hand grip 44 were released, line 36 would be retracted through pulley 104 thereby shortening run 34. As long as the same amount of line is extended through pulley 86 as is retracted through pulley 104, lift pulley 58 will remain at the same height. However, the user must exert force upon hand grips 42 and 44 to maintain platform 20 in its initial horizontal position. Additionally, as the amount of force of hand grips 44 is lessened, allowing hand grip 44 to be drawn toward pulley 104, the amount of force required to extend line 36 from pulley 86 increases. Similarly, when the direction of pull is reversed, the amount and direction of force on hand grips 42 and 44 will be symetrically reversed. It is thus not possible in performing an alternating exercise as described above to allow one arm to provide the major driving force. Each arm must at some time during the exercise provide the same amount of force as the opposing arm in order to maintain platform 20 in a steady position. Only when both hand grips 42 and 44 are extended or retracted toward their corresponding pulleys in FIG. 2 does platform 20 rise or fall. Even in that case, the same amount of force must be exerted by each arm if they are extended or retracted at a uniform rate toward or from their respective pulleys. Again, each arm must be equally exercised when performing a curl utilizing the exercise machine in the present invention as constituted in FIG. 2 and the level of platform 20 provides an indicator to the exerciser that he is exercising both arms equally.

Referring now to FIG. 5, greater detail of adjustable bench 16, shown in exploded perspective view, can be appreciated. Adjustable bench 16 includes board 18 which is fixed by conventional means to a frame 108. Frame 108 is also provided at its lower end with an end bar 110 forming part of foot stirrups 112. Bar 110 also includes a pair of flanges 114 through which a pilot hole is defined to allow frame 108 to be secured to a center rail 116 included as part of base 12. As best shown in FIG. 1, a pin is inserted through the holes defined in flange 114 under rail 113 so that adjustable bench 16 is securely maintained in the inclined position even when loaded by an exercising user.

Frame 108 is rotatably coupled to a stanchion tube 116. Stanchion tube 116 is rotatably coupled to frame 108 by any means well known to the art, such as by a hinge, ball and socket combination or pivot rod welded to a plate welded in turn to stanchion 116 and rotatable disposed through frame 108. Stanchion 116 telescopically couples with a stanchion tube 118 which in turn is fixed to sliding base 120. The internal diameter of tube 118 is such that it is slightly larger than the outer diameter of tube 116 thereby allowing 116 and 118 to telescopically engage each other with a free but secure fit. Both stanchion tubes 116 and 118 are provided with a plurality of through holes defined on the diameters of each tube and vertically displaced along the longitudinal axis of each tube.

The distance of frame 108 from the slideable base 120 is selected and fixed by insertion of a rod through corresponding holes defined in tubes 116 and 118. Lower tube 118 is fixed to slideable base 120 through a base plate 122 welded to center rails 124, and in addition thereto has a plurality of support struts 126 welded between lower tube 118 and outside rails 128 of sliding base 120. Sliding base 120 further includes end bars 130 wherein each end includes a slightly "V"-shaped retaining runner 132 arranged and figured to clasp outside rails 134 of base 12. Frictional engagement between runners 132 and rails 134 is sufficient due to the "V"-shape of runner 132 such that no further locking means is required to prevent sliding of adjustable bench 16 along base 12 even when loaded by an exercising user.

In addition, adjustable bench 16 may include a pair of locking, telescoping support struts 136 rotatably coupled at one end to end bars 130 of sliding base 120 and coupled at the other end to flange 114 on end bar 110 of frame 108 or flange 138 at end 140 of frame 108. Therefore, when incline board 18 is adjusted to a position such that end flange 114 cannot be coupled with central rail 113 in the manner described above, telescoping support struts 136 can each be adjusted to attach to one end of frame 108 and then tightened to assume a fixed length thereby rigidly supporting the inclination of incline board 18. Thus, it can be readily appreciated that inclined board 18 may not only be adjusted at any distance from A-frame 14 but may also be rotated and inclined at an arbitrary inclination with respect to base 12 in order to best fit the exercise to be performed.

As stated, exercise apparatus 10 may be configured in a large variety of ways to accommodate virtually an arbitrary number of types of exercises. For example, incline board 18 may be adjusted to be inclined toward A-frame 14 by a small angle allowing the user to lie down on inclined board 18 with his feet toward A-frame 14. The toes of the user are then inserted through grips 42 and 44 or simply through loops formed in ends 28 and 30 through which the lower foot portion of the user is inserted. Lower pulleys 86 and 104 are positioned on flange 87 in the configuration shown in FIG. 1. The user then draws his knees upward in either an alternating or simultaneous fashion to perform an alternating knee lift or deep knee bend exercise.

In addition to use for knee lifts, grips 42 and 44 may be configured in conjunction with pulley system 22 to allow the user to perform alternating bicep curls, front lift deltoid exercises, backstroke catch ups, butterfly presses, controlled bench presses, alternating leg curls, an eggbeater leg exercise, a free style catch up stroke, bicep extensions, and many other arm, leg and body exercises. Bar 40, shown in FIG. 1, can similarly be configured in combination with pulley system 22 of the present invention to allow the user to perform straight arm pull-overs, prone bench presses, bicep curls, tricep extensions, overhead lift extensions, sit ups and many other exercises using a bar.

One of the additional freatures of the exercise apparatus is that the coupling of A-frame 14 to base 12 can be made by conventional bolts and nuts, or quick release pins disposed through holes defined in upright flanges 142 formed as part of base 12 and into corresponding holes defined into legs 74 and 76 of A-frame 14. Thus, if the exerciser chooses, front legs 76 may be uncoupled from flanges 142 allowing A-frame 14 to be collapsed and folded forward into a substantially parallel configuration with base 12, after adjustable bench 16 has been removed. Bench 16 may also be separated into at least two portions as suggested in FIG. 5 by the removal of upper stanchion tube 116 from its telescoped position within lower tube 118. Upper tube 116 then folds relatively flatly against the bottom of frame 108 and bench 116 can be stacked on folded A-frame 14 and base 12 to allow for a compact storage of exercise apparatus 10. When folded the entire apparatus can be easily transported by a single individual.

Although only a few configurations of pulley system 22 of exercise apparatus 10 has been illustrated, it must be understood that many modifications and alterations may be made to pulley system 22 as well as to the invention generally by those ordinary skill in the art without departing from the spirit and scope of the present invention. The embodiment described above has been set forth for the purpose of illustration only and should not be taken to limit or restrict in any manner the scope of the following claims.

I claim:

1. An exercise apparatus for lifting weights using a flexible line having a first end and a second end, which ends are manually manipulable, either separately or simultaneously, said apparatus comprising:

a vertical frame having an upper and lower portion and a horizontally-extending base;

a weight platform perpendicular to said vertical frame having a free-swinging end configured for carrying said weights and an opposite end disposed adjacent the lower portion of said frame;

a plurality of upper pulleys coupled to the upper portion of said vertical frame;

connection means pivotally connecting the lower portion of said vertical frame to said opposite end of said weight platform, whereby the free-swinging end of said weight platform will remain in a generally vertical plane below said upper pulleys during normal swinging movement of said platform and the pivotable opposite end being attached to the frame at a position more remote from the user than the free end of the platform; and an opposing lift pulley attached to the free-swinging end of said weight platform, the intermediate portion of said flexible line being woven through said upper pulleys and said opposing lift pulley.

2. The apparatus of claim 1 wherein said connection means includes a double linkage comprised of a pair of arms, each arm being rotatably coupled at one end to said frame and at the opposing end to said platform.

3. The apparatus of claim 1 wherein said weight is coupled to said platform near said free-swinging end.

4. The apparatus of claim 3 where said arms are of sufficient length such that said opposing lift pulley is positioned vertically beneath said upper pulleys.

5. The apparatus of claim 4 where said range of operating orientations includes an angular inclinations of the plane of said platform with respect to the vertical of approximately 5° to 125° degrees.

6. The exercising machine of claim 1 further including an adjustable bench disposed on said horizontally extending base of said frame and slideable thereon for selective displacement with respect to of said frame.

7. The exercise apparatus of claim 1 further including a pair of lower pulleys coupled to the lower portion of said frame wherein said flexible line is woven through said upper pulleys, said opposing lift pulley, and said pair of lower pulleys.

8. The exercise apparatus of claim 7 wherein said frame includes at least two flanges connected to the lower portion of said vertical frame and said lower pulleys including two single-sheaved pulleys, each pulley coupled to a corresponding one of said flanges, said line being led through one of said lower pulleys up to one of said plurality of upper pulleys, through said one upper pulley and downward to said lift pulley, said lift pulley being a double-sheaved pulley, said line then being led back up to a center, single-sheaved, upper pulley and downward through said double sheaved lift pulley, said line continuing upward from said double sheaved lift pulley to third, single-sheaved, upper pulley and downward to and through the remaining single-sheaved, lower pulley, whereby said flexible line is woven through said pulleys such that extension of one end of said line requires withdrawal of the opposing end of said line if said lift pulley is maintained in an approximately stationary position, and such that when both ends of said line are extended from said frame, said platform is caused to pivot around said connection means and is raised by said lift pulley.

9. The exercise machine of claim 7 wherein said upper and lower pulleys are selectively coupled to said lower and upper portions of said frame, respectively, by attachment through a selected one of plurality of mounting holes defined in said lower and upper portions of said frame, whereby the range of exercise possible with said exercising machine are substantially increased.

* * * * *